United States Patent [19]

Campbell

[11] 4,037,369

[45] July 26, 1977

[54] FLOOR MAINTENANCE BRUSH

[76] Inventor: Murray Robert Campbell, Unit W1, Windsor Towers, 9 Parker St., South Perth, Australia

[21] Appl. No.: 618,617

[22] Filed: Oct. 1, 1975

[30] Foreign Application Priority Data

Oct. 3, 1974 Australia ..... 9145/74

[51] Int. Cl.[2] ..... B24D 13/14; A46B 9/06

[52] U.S. Cl. ..... 51/400; 15/159 A

[58] Field of Search ..... 51/24, 177, 400, 397, 51/398, 404; 15/159 A, 180

[56] References Cited

U.S. PATENT DOCUMENTS

| | | | |
|---|---|---|---|
| 959,054 | 5/1910 | Glover | 51/398 |
| 1,093,437 | 4/1914 | Koeppen | 15/180 X |
| 1,206,031 | 11/1916 | Ritter | 15/180 |
| 2,196,079 | 4/1940 | Pyle | 15/180 X |
| 3,072,944 | 1/1963 | Clayton | 15/159 A |
| 3,605,347 | 9/1971 | Barry | 51/400 X |
| 3,758,393 | 9/1973 | Smith | 51/404 X |

*Primary Examiner*—Al Lawrence Smith
*Assistant Examiner*—Nicholas P. Godici

[57] ABSTRACT

A brush or pad having fibers of varying abrasive characteristics, the fibers of greater abrasive characteristics being located towards the center of the brush and the fibers of lesser abrasive characteristics being located towards the outer periphery of the brush.

10 Claims, 3 Drawing Figures

FLOOR MAINTENANCE BRUSH

This invention relates to improved floor maintenance brushes.

Previously, the cleaning and maintenance of hard floor surfaces has been carried out by machine driven brushes wherein the brushware is rotationally driven and comprised of natural or man-made fibres, or lofted pads of nylon or polyester fibre, containing various grades of abrasive grit. These pads and brushes have almost universally been of one fibre type and/or have one degree of abrasion over their entire operating surface. Because of this, different brushes were required for scrubbing and polishing and therefore the cleaning operation became very time consuming. Hard floor surfaces which are subject to heavy traffic are generally worn to a greater extent than areas of light traffic. For example, doorways, passageways and entrances are worn far more than the general office area. Until now, a cleaner had to make a compromise between firstly a brush which was ideal for polishing light traffic areas and yet was relatively inefficient in removing scuffing and marks from the heavy traffic areas, and, secondly a brush which rapidly and effectively removes scuffing and marks from heavy traffic areas, but one which was detrimental to highly polished areas due to the abrasive nature of the brush.

One of the objects of this invention is to provide a brush which is capable of overcoming the above disadvantages and provide a cleaner and the like with a brush that will prove efficient at cleaning heavy traffic areas and at the same time still leave a highly polished surface to both the light and heavy traffic areas.

In one form the invention resides in a brush or pad having fibres of varying abrasive characteristics, the fibres of greater abrasive characteristics being located towards the centre of the brush and the fibre of lesser abrasive characteristics being located towards the outer periphery of the brush.

Preferably a support strap is placed between areas of varying abrasive characteristics. This helps to prevent the flattening or spreading of the fibres and in particular prevents the heavier more abrasive fibres from intruding into areas containing less abrasive fibres.

The invention will be better understood by reference to the following description of one specific embodiment as shown in the accompanying drawings wherein.

In this embodiment a brush or pad is constructed to take maximum advantage of the rotational means employed to drive a brush, and to use the rotational motion to maximize efficiency by polishing a floor surface to a high finish and to rapidly remove scuffing and wear where required.

Before describing the actual make up of a brush or pad it is necessary to have a full understanding of the principles involved. By using the rotational motion of a constantly revolving plate we know that the closer one gets towards the centre then the effective velocity diminishes in proportion to the radius of the plate. An example can be given with the normally accepted size industrial cleaning brush which has a 16 inch diameter.

The velocity of the periphery of such a brush, being driven at 400 rpm is 27.93 feet per second. This velocity diminishes by 3.49 feet per second for the reduction in radius of one inch.

This factor is therefore being utilized in this invention as the more abrasive fibres are placed closer to the centre of the brush. There is an increasing degree of abrasion as the radius of the brush diminishes. Similarly the outer edge fibres are rotating at maximum velocity for that particular radius brush and are constructed of fibres most suitable for polishing. As the radius of the brush diminishes the rows of tufts are filled with a fibre mix which becomes progressively more abrasive until the centre most fibres are formed of nylon containing 54 mesh silicon carbide grit or similar construction suitable for the removal of scuffing and general wear.

Figure 1:
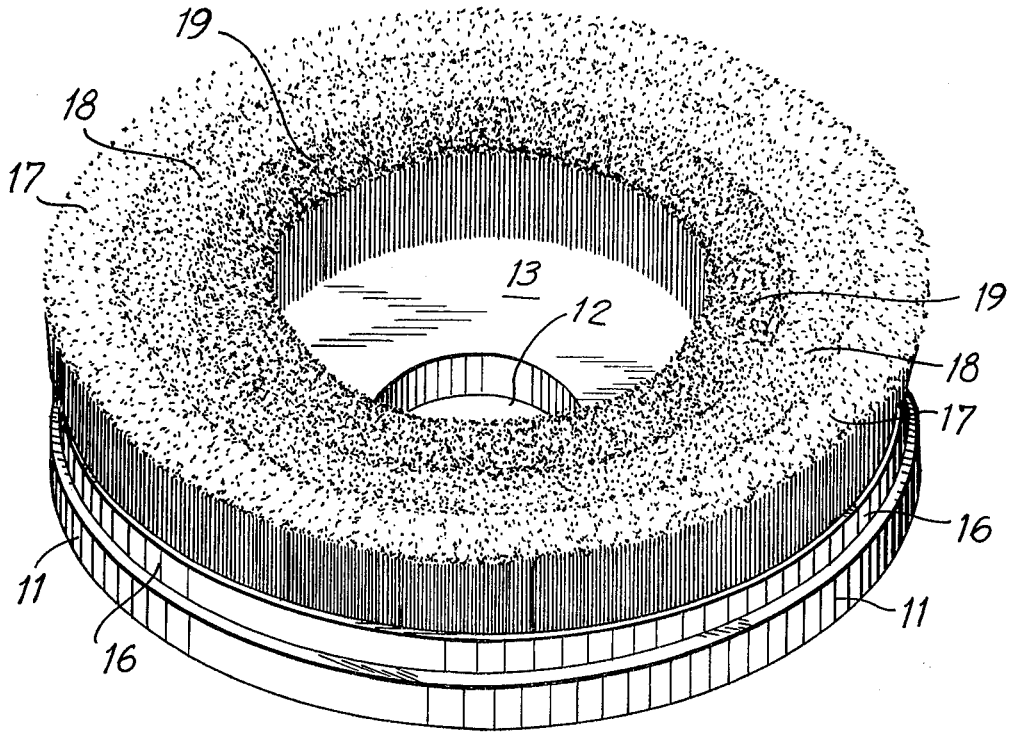
FIG. 1 is a perspective view of the brush showing the varying abrasive characteristics of the fibres.
Figure 2:
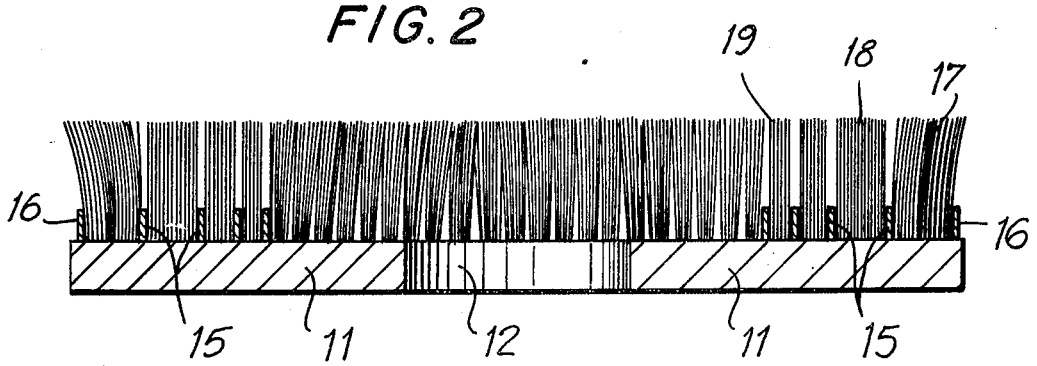
FIG. 2 is a transverse sectional view through the brush in FIG. 1.

In the embodiment shown in FIGS. 1 and 2 of the drawings a brush is constructed comprising a substantially circular backing plate 11, provided at its centre with a substantially circular opening or recess 12. The opening or recess 12 being formed to securely engage with a cleaning machine. Surface 13 of the backing plate 11 has a plurality of annular drill holes placed therein to accommodate the tufts of fibres. If desired, a support strap 15 may be placed between the various grades of abrasive fibres to prevent spreading of the fibres. A support strap 16 is then placed around the periphery of the outer row of fibres to ensure that the brush retains its original shape for as long a period as possible, and also to ensure that flattening of the outer softer fibres is restricted. Generally, the support strap 15 is placed between areas of varying abrasive characteristics. This helps to prevent the flattening or spreading of the fibres and in particular prevents the heavier more abrasive fibres from intruding into areas containing less abrasive fibres. The floor behaviour of a brush normally changes during the life of the brush, however, with the assistance of support straps, the shape and life of the brush is extended. The behavoral change normally arises from the heavy fibres spreading outwardly which results in an increased velocity of these fibres and therefore a more abrasive effect on the floor surface.

In FIGS. 1 and 2 of the drawings a brush is shown wherein the outer two rows 17 are formed of pure bassine, the next inner two rows 18 are formed of a mixture of approximately 50% bassine and 50% nylon filament incorporating 120 mesh size aluminium oxide grit. The innermost 3 rows 19 were then formed of nylon filament incorporating 54 mesh size silicon carbide grit.

This particular design or arrangement of fibres was found to be most effective for all types of hard vinyl floors, especially where it was found necessary to carry out "Spray Buffing". Spray buffing being where limited scrubbing is required to be carried out on a badly worn area such as a doorway; moisture is applied with a spray gun and the area scrubbed until the friction generated between brush and floor dries and then polishes the floor surface.

Figure 3:
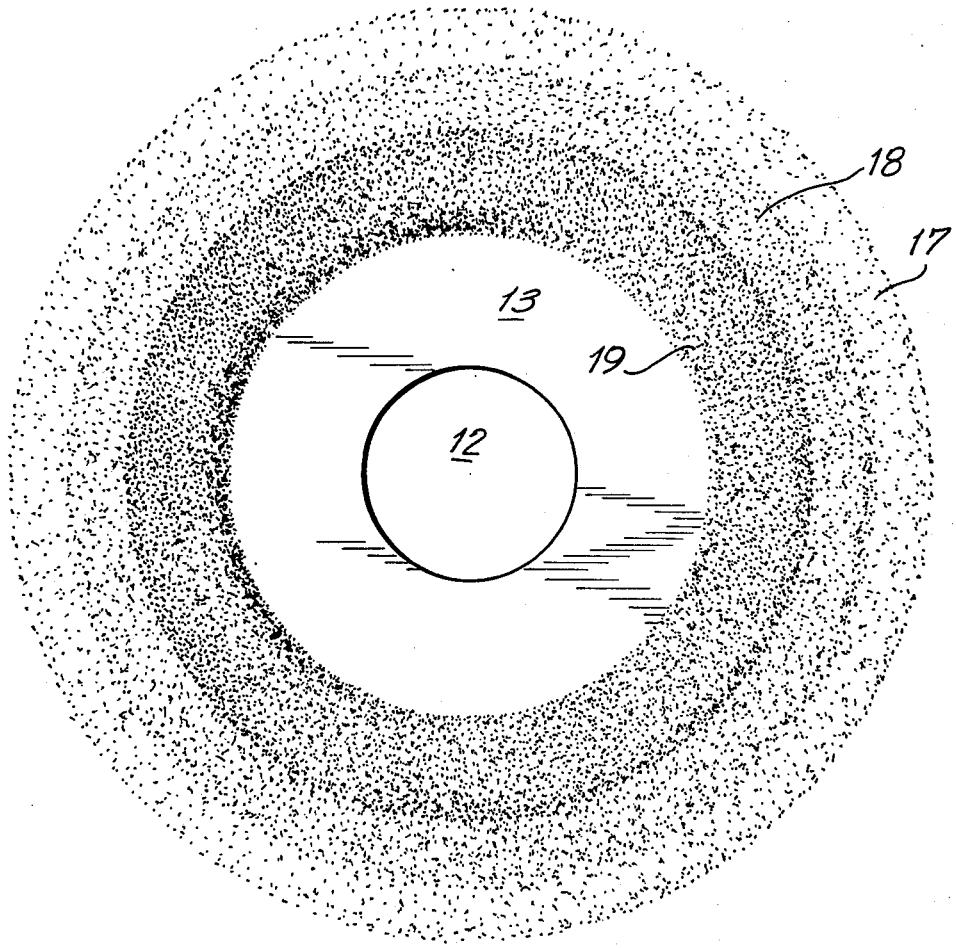
FIG. 3 is a plan view of a further embodiment wherein there are distinct bands of different fibres.

A further fibre arrangement was consructed as shown in FIG. 3 of the drawings wherein the two outer rows were formed of union fibre i.e. a mixture of 50% tampico and 50% bassine.

The next two rows were formed of pure bassine and the three innermost rows of extruded nylon filament containing 54 mesh size silicon carbide grit. This particular arrangement was found to be most effective on softer surfaces such as fully flexible vinyl and on the harder types of vinyl where wear was not particularly heavy and spray buffing not required.

In development of fibre arrangements it was found that a brush constructed with 54 mesh size silicon carbide grit in the innermost rows and progressively changing through grit sizes 80, 120, 180, 320 until a size of 500 or the like was located on the outermost row, resulted in a large amount of 'drag' or friction on the floor surface which can cause an overload on the machine resulting in 'burnt out' motors or blown fuses.

The above fibre arrangements are by way of examples only and the brushes shown in the drawings can be made in lesser grit sizes; therefore, less abrasiveness, both in the inner three rows and the two rows containing a mixture of fibres. In this way, heavy medium and light duty brushes can be constructed to suit floors of varying hardness and wear characteristics.

In operation, floor surfaces to be cleaned are not homogeneous in respect of wear and cleanliness. However, they can be effectively and efficiently cleaned by the correct handling of the above described brushes. Where wear is at a minimum the brush is moved quickly over the floor surfaces thereby allowing only the faster moving outer polishing fibres to have any noticeable effect. The inner more abrasive fibres are moving at a slower speed and have insufficient time over any particular point of the floor surface to produce any obvious abrading. Obviously where areas of heavier wear are encountered then the brush is moved slowly and the inner abrasive fibres remove the signs of wear and the outer fibres produce a degree of finish consistent with that of the less worn areas. If desired "spray buffing" may be carried out on areas of heavy wear or the areas may be treated dry.

The above description and details have been developed for use in Australia where the standard industrial cleaning brush is of 16 inch diameter and the machine operates from between 350 - 500 rpm. Obviously for larger diameter brushes containing the same fibres then a slower number of revolutions per minute would be required and vice versa. Different grades of abrasive fibres and different floor surfaces may require constructions slightly different from that explained and shown in the drawings.

Whilst the invention has been described with reference to one specific embodiment it will be realized that many arrangements of fibre constructional detail and design may be made to the above described embodiment without departing from the broad scope and ambit of the invention as are defined in the appended claims.

I claim:

1. A brush or pad having fibres of varying abrasive characteristics, the fibres of greater abrasive characteristics being located towards the centre of the brush and the fibres of lesser abrasive characteristics being located towards the outer periphery of the brush, the outermost annular tufts of fibres being constructed of pure bassine, the next inner annular tufts of fibre being constructed of a mixture of bassine and nylon filament and the innermost annular tufts being constructed of nylon filament, said nylon filament incorporating an abrasive grit.

2. A brush or pad as claimed in claim 1 wherein the fibres of greater abrasive characteristics are of larger diameter and the fibres of lesser abrasive characteristics are of smaller diameter.

3. A brush or pad as claimed in claim 1 wherein the varying abrasive fibres are disposed in distinct annular bands.

4. A brush or pad as claimed in claim 3 comprising at least one support strap placed between said annular tufts to provide support and constant relative position for said fibres.

5. A brush or pad as claimed in claim 4 comprising a further support strap placed around the periphery of the outermost annular tufts.

6. A brush or pad as claimed in claim 2 wherein the varying abrasive fibres are disposed in distinct annular bands.

7. A brush or pad as claimed in claim 6 comprising at least one support strap placed between said annular tufts to provide support and constant relative position for said fibres.

8. A brush or pad as claimed in claim 7 comprising a further support strap placed around the periphery of the outermost annular tufts.

9. A brush or pad comprising a substantially circular backing plate and fibres of varying diameter and abrasive characteristics secured to and projecting from one face of said plate, the larger diameter fibres being more abrasive and impregnated with abrasive particles, the larger diameter fibres being positioned in the central region of the brush, said fibres decreasing in diameter and abrasive characteristics radially outwardly on said plate, the least abrasive fibres being unimpregnated and disposed in the outer peripheral area of the brush.

10. A brush or pad as claimed in claim 9 comprising a support strap placed around the periphery of the outermost unimpregnated fibres to provide support for said outermost fibres.

* * * * *